US006626776B2

(12) United States Patent
Barrie et al.

(10) Patent No.: US 6,626,776 B2
(45) Date of Patent: Sep. 30, 2003

(54) EXPANDABLE BROADHEAD WITH MULTIPLE SLIDING BLADES

(75) Inventors: Bruce Barrie, Waseca, MN (US); Ronald E. Way, Scottsdale, AZ (US); Carl J. Pugliese, Chandler, AZ (US)

(73) Assignee: Barrie Archery, LLC, Waseca, MN (US)

( * ) Notice: Subject to any disclaimer, the term of this patent is extended or adjusted under 35 U.S.C. 154(b) by 0 days.

(21) Appl. No.: 10/233,341

(22) Filed: Sep. 3, 2002

(65) Prior Publication Data

US 2003/0004021 A1 Jan. 2, 2003

Related U.S. Application Data

(62) Division of application No. 09/798,578, filed on Mar. 3, 2001, now Pat. No. 6,517,454.
(60) Provisional application No. 60/188,683, filed on Mar. 13, 2000.

(51) Int. Cl.[7] ..... F42B 6/08
(52) U.S. Cl. ..... 473/583
(58) Field of Search ..... 473/578, 583, 473/584

(56) References Cited

U.S. PATENT DOCUMENTS

| | | | | |
|---|---|---|---|---|
| 3,138,383 A | * | 6/1964 | McKinzie | |
| 5,112,063 A | | 5/1992 | Puckett | 273/421 |
| 5,172,916 A | | 12/1992 | Puckett | 273/421 |
| 5,178,398 A | | 1/1993 | Eddy | 273/421 |
| 5,322,297 A | | 6/1994 | Smith | 273/421 |
| 5,458,341 A | | 10/1995 | Forrest | 273/421 |
| 5,472,213 A | | 12/1995 | Dudley | 273/421 |
| 5,564,713 A | | 10/1996 | Mizek | 273/421 |
| 5,803,844 A | | 9/1998 | Anderson | 473/583 |
| 5,857,930 A | | 1/1999 | Troncoso | 473/583 |
| 5,879,252 A | | 3/1999 | Johnson | 473/583 |

* cited by examiner

*Primary Examiner*—John A. Ricci
(74) *Attorney, Agent, or Firm*—Patterson, Thuente, Skaar & Christensen, P.A.

(57) ABSTRACT

A broadhead having a penetrating forward tip, a longitudinally extending body with threads on the rear end thereof for attachment to an arrow shaft. The body includes a single longitudinally extending passage or, alternatively, two or more longitudinally extending grooves for receiving blades therein. The blades are provided with a longitudinally extending, weight or mass reducing slot and are held within their respective passage or grooves with a transversely positioned or friction holding member which permits rearward sliding movement resulting in outward expansion of the blades while retaining a portion of the blades within the passage or groove. The front end of the blades extends outwardly of the body to contact the target surface to provide a rearward moving force to the blades upon such contact. The slots of the blades are formed to allow the rearward ends thereof to move outwardly to an expanded cutting position as they move relative to the holding member or, alternatively, the blades are directed outwardly by an additional transverse, camming member as they move relative to the holding member.

8 Claims, 4 Drawing Sheets

3
3
7
7
11
11a
11b
11c
11s
12
13
13a
13b
13c
13d
13e
13g
14
14a
14b
14c
14d
14e
14g
14h
15
16

EXPANDABLE BROADHEAD WITH MULTIPLE SLIDING BLADES

RELATED APPLICATIONS

This application claims the benefit of U.S. Provisional Application, No. 60/188,683 filed Mar. 13, 2000, entitled Mechanical Broadhead Arrowhead and is a Divisional Application derived from application for U.S. Pat. No. 09/798,578, filed Mar. 3, 2001, now U.S. Pat. No. 6,517,454 entitled Broadhead with Sliding, Expanding Blades. Other than these applications, applicants have not filed any application containing related material and are not aware of any applications by others that relate to the same or similar material.

SPONSORSHIP

This invention is the sole product of the listed applicants and was not made under any Federal or Independent Sponsorship.

FIELD OF THE INVENTION

This invention relates generally to broadheads, which are often referred to as broadhead arrowtips or arrowheads but which, among users, are simply referred to as broadheads and more specifically to an expanding broadhead which has an inflight configuration and dimension and which, upon striking a target, expands the rear of the blades outwardly to result in a larger entrance opening to insure kill of the intended target. More specifically, the blades of the broadhead embodying the invention disclosed herein relate to an expanding broadhead wherein the blades are forced rearwardly upon striking a target and are slid withing a capturing passage or groove, being held withing the same by a transversely extending or friction providing member positioned relative to a mass reducing guide within the blade such as a slot. As the blades are forced rearwardly, the rearmost ends of the same are shifted outwardly, either by a camming member of due to the guide or slot configuration, to an expanded cutting position.

SHORT SUMMARY OF THE INVENTION

An expandable broadhead having two or more blades, either singularly, arcuately spaced about the broadhead body within the grooves or, alternatively, when provided as a single pair of blades, within a single passage provided through the broadhead body. In either arrangement a frontal portion of the blades extends outwardly of the diameter of the body to abut with a target as the broadhead penetrates and enters the same. The abutment of this frontal portion will cause the blades to move rearwardly and during such rearward movement, the rear of the blades is cammed or guided outwardly into expanded position to enlarge the opening made into the target.

BACKGROUND, OBJECTS AND ADVANTAGES OF THE INVENTION

The use of broadheads is well known in the bow hunting art and various broadheads including both expanding and solid blade types are available. The function of the expanding blade is to provide a relatively small, inflight dimension with the blades being outwardly moveable upon striking a target, to expand the blades to an open position. The solid blade maintains its dimension during flight and when entering the target. The advantage of the small, inflight dimension is the trueness of flight which is available as cross winds will not effect the flight as they are at to do with a solid blade design.

It is an object of the applicants' invention to provide an expanding broadhead wherein two blades are arranged for sliding movement within a single transverse passage through the broadhead body or single blades, preferably three, are provided in separate, arcuately spaced grooves formed in the broadhead body such that the blades, in either arrangement, provide an inflight, collapsed dimension and, upon the broadhead striking a target, move rearwardly and are cammed or guided outwardly into an expanded, cutting dimension.

It is further object of the applicants' invention to provide an expandable broadhead wherein a pair of blades are arranged for sliding movement within a single passage formed through the body of the broadhead and the blades are each provided with a guide element such as a slot formed in the blade, which slot allows for rearward movement and outward shifting of the rear of the blades into their expanded cutting position.

It is a further object of the applicants' invention to provide an expandable broadhead wherein the blades thereof are provided with a longitudinally extending slot of selected configuration to assist in outward camming of the rear of the blades as they are moved rearwardly upon striking a target.

It is a further object of the applicants' invention to provide an expandable broadhead wherein, preferably three, individual blades are provided in arcuately spaced grooves formed in the broadhead body and are held and retained therein allowed to move rearwardly upon the broadhead striking a target with guide means provided between each groove and blade to allow for outward movement of the rear ends of the blades upon striking a target.

These and other objects and advantages of the applicants' invention will more fully appear from a consideration of the accompanying drawings and description.

SHORT DESCRIPTION OF THE DRAWINGS

DESCRIPTION OF PREFERRED FORMS OF THE INVENTION

As illustrated in the various view, the invention may take two forms which are basically the same in their inventive concept. The first of the forms, shown in FIGS. 1, 3, 4, 5 and 6 provides a pair of blades which are mounted within a singular, longitudinally extending passage which is formed entirely through the body of the broadhead. The second of the forms, shown in FIGS. 2, 7, 8, 9 and 10 provides, preferably, three blades, spaced arcuately about the body of the body of the broadhead. In either form, the blades are provided with means to retain at least the front end of the same within the passage or groove during movement of the same and are provided with a mass or weight reducing blade guiding slot which guides and limits the movement thereof as the same is moved rearwardly and expanded outwardly when striking the target.

In the first form of the invention as illustrated in FIGS. 1, 3, 4, 5 and 6, broadhead body 11 is provided with a front, target penetrating end 11*a* and a read, arrow shaft attachment end 11*b*. The body 11 is provided with a longitudinally extending, transverse passage 12 entirely therethrough with a pair of blades 13, 14 mounted therein. The target penetrating end 11*a* may take any of several known forms such as conical, faceted, straight taper or razor insert tip.

Figures 1, 2, 3:
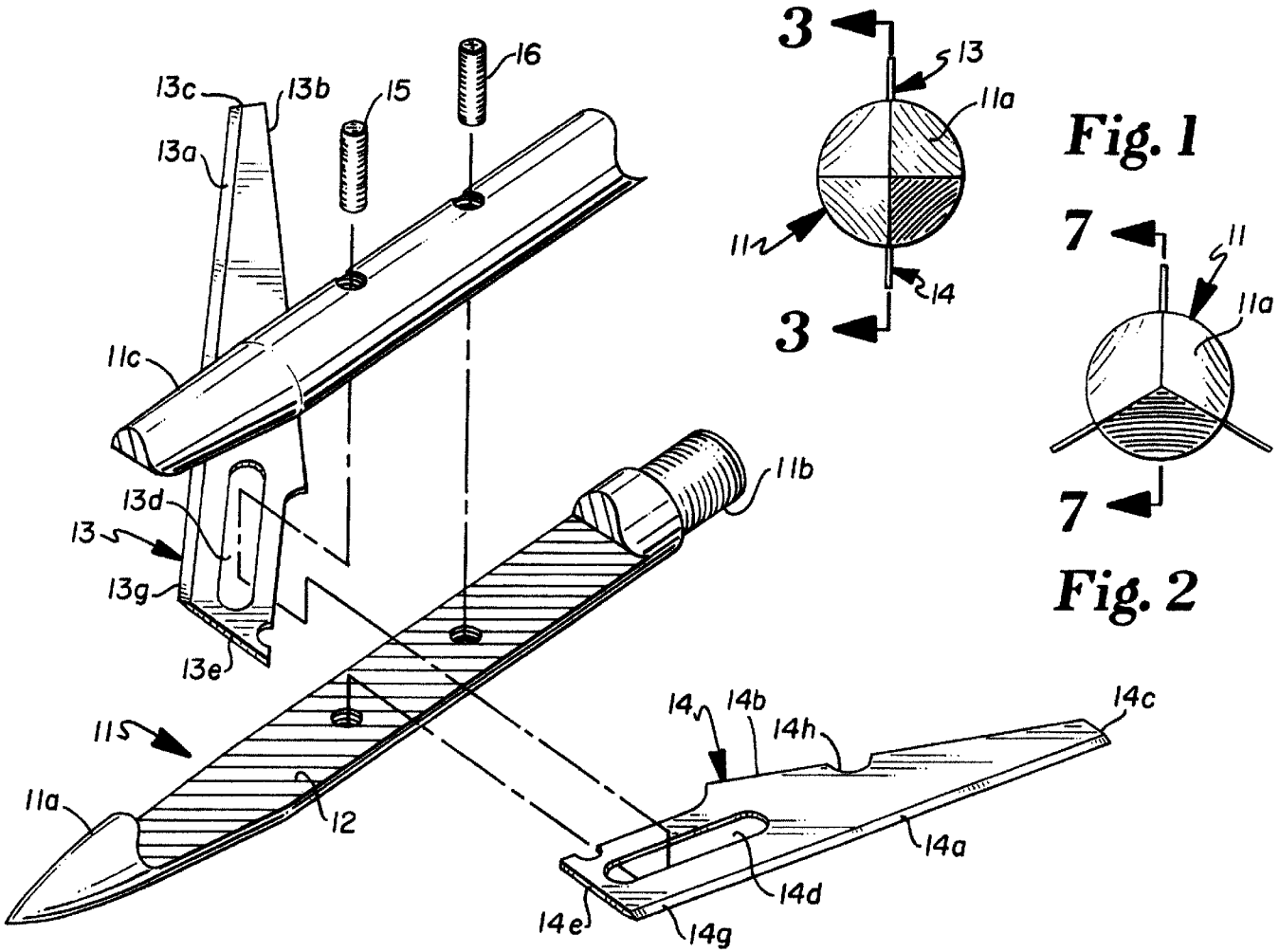
FIG. 1 is a front view of an expanding broadhead embodying the concepts of the applicants' invention wherein the broadhead is provided with a pair of blades.
FIG. 2 is a front view of an expanding broadhead embodying the concepts of the applicants' invention wherein the broadhead is provided with at least three arcuately spaced blades, it being understood that this number may be increased.
FIG. 3 is an exploded view of the expanding broadhead taken substantially along Line 3—3 of FIG. 1, with portions thereof separated for ease of description.

In FIG. 3, one side 11*c* of body 11 has been broken away from the remainder of the body 11 to illustrate the blades 13, 14 as they would be mounted therein. It should be appreciated that the body 11 may actually be provided with a removable side, such as 11*c* which would be attachable to the remainder of the body 11.

Each of the blades 13, 14 includes an outwardly directed cutting surface 13*a*. 14*a* and a camming surface 13*b*, 14*b*, opposite such cutting surface 13*a*, 14*a* with a locating cutout or notch 13*c*, 14*c* formed at the rear of the camming surfaces 13*b*, 14*b* which will locate the blades 13, 14 for the inflight position. Each of the blades 13, 14 also includes a mass or weight reducing, longitudinally extending slot 13*d*, 14*d* which lies between surfaces 13*a*, 13*b*, 14*a*, 14*b* and, as is shown, may be parallel to cutting surfaces 13*a*, 14*a*.

A first transversely positioned, blade locating and retaining member, such as a pin or screw 15 extends entirely through body 11 and through slots 13*d*, 14*d* to retain the blades 13, 14 within the body passage 12. Apertures, not numbered, receive such member 15. This member 15 allows longitudinal rearward movement of blades 13, 14 within passage 12 and allows the rear ends 13*f*, 14*f* of blades 13, 14 to expand outwardly into cutting into cutting position but does not allow the blades to be removed from passage 12 without removal of the same.

A second transversely positioned pin or screw 16 extends entirely through body 11 and passage 12 to provide a cam which is received into cutout or notch 13*c*, 14*c* when the blades 13, 14 are in their inflight or collapsed position and which acts against camming surfaces 13*b*, 14*b* as the blades 13, 14 are forced rearwardly by abutment of their forward ends 13*e*, 14*e* against a target to force the rear ends 13*f*, 14*f* of the blades 13, 14 outwardly into cutting position.

To hold the blades 13, 14 in their inflight position, a notch 13*g*, 14*g* is formed in the camming edges 13*b*, 14*b* of the blades 13, 14 adjacent the forward ends 13*e*, 14*e* thereof and a blade retaining member, breakable or unbreakable, or a friction member 17 is received into such notches 13*g*, 14*g* to hold the blades 13, 14 in collapsed position.

Figure 5:
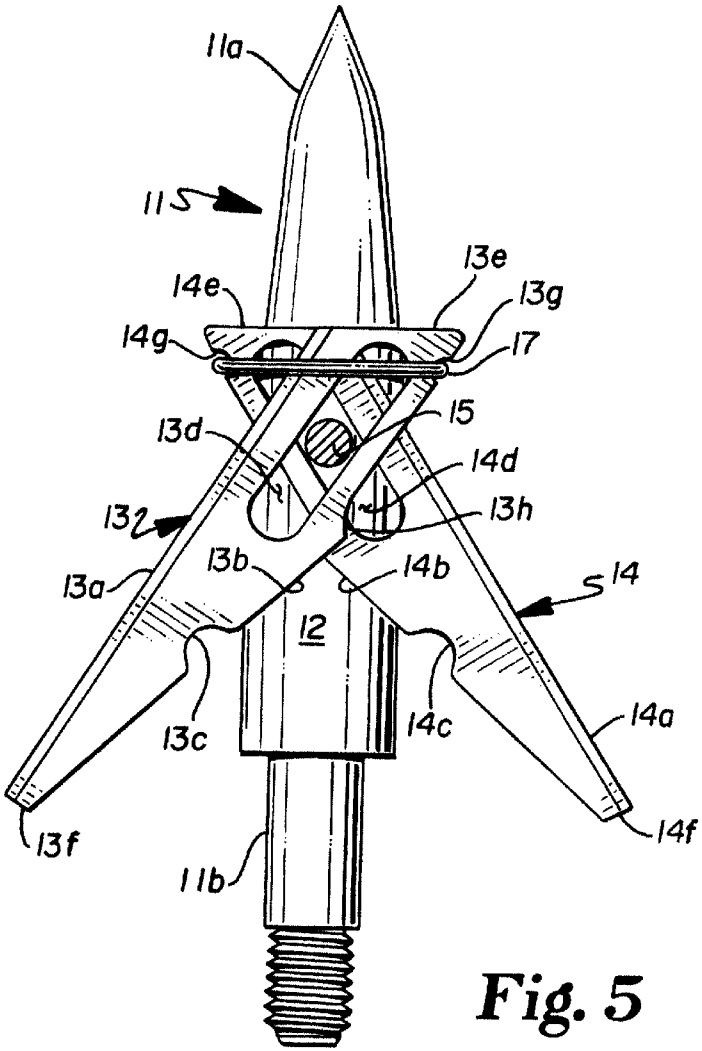
FIG. 5 is a view similar to FIG. 4 illustrating the expanding bladed of the broadhead in a partially expanded position.
Figure 4:
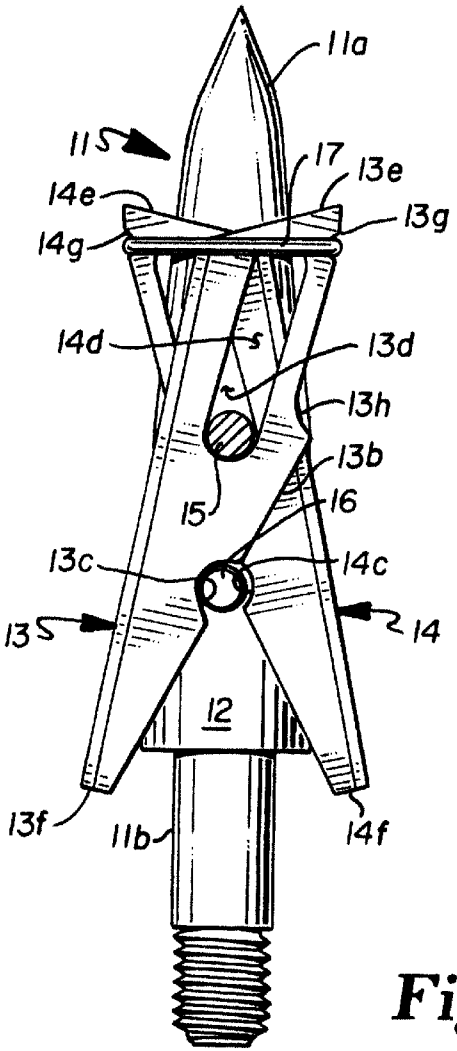
FIG. 4 is a view taken substantially along line 3—3 of FIG. 1 illustrating the expanding blades of the broadhead in their inflight position.

As illustrated, particularly in FIGS. 4 and 5, the forward ends 13*e*, 14*e* of blades 13, 14 extend outwardly from the radial dimension of the body 11 such that these ends 13*c*, 14*e* will abut with the target upon the broadhead striking the same to force the blades 13, 14 rearwardly against cam pin 16 to cause the rear ends 13*f*, 14*f* of the blades 13, 14 to move into an expanded cutting position where their increased diameter will enlarge the target opening to insure animal kill.

To hold the blades in their expanded position and prevent their return, lugs 13*h*, 14*h* are provided on the camming surfaces 13*b*, 14*b*. These lugs 13*h*, 14*h* will, when the blades 13, 14 are at their expanded position, lock against pin 16 to prevent return of the blades 13, 14. However, the blades may be so designed that upon retrieval of the arrow from the target, the blades 13, 14 will be able to continue rotation about pin 15 such that the blades 13, 14 and their camming surfaces 13*b*, 14*b* will be forwardly directed to prevent barbing of the broadhead with the wound area which is illegal in many sates.

The use of this form of the broadhead should be obvious to anyone skilled in the art. The blades 13, 14 are placed in their forwardmost position with the notches or cutouts 13*c*, 14*c* in registration with cam member 16. The holding member 17 is then arranged within notches 13*g* 14*g* to hold the blades 13, 14 in what has been termed an inflight position. Upon the broadhead striking and penetrating a target, the broadhead will enter the target and the forward ends 13*e*, 14*e* of the blades 13, 14 will come into contact with the target to force the blades 13, 14 rearwardly and continued penetration will continue such rearward blade movement. As the blades 13, 14 move rearwardly, the camming surfaces 13*b*, 14*b*, riding against the camming element 16 will force the rear ends 13*f*14*f* outwardly to target cutting position to enlarge the penetration aperture with the blades 13, 14 being prevented form returning due to engagement of lug 13*h*, 14*h* with pin 16. The holding member 17, if a non-reusable type is used, will normally be cut by the blade cutting surfaces 13*a*, 14*a* as it is driven rearwardly and, if not so cut, would be available for next use of the blade. Removal of the blades from the target with the permitted, continued movement thereof has been explained.

Figure 6:
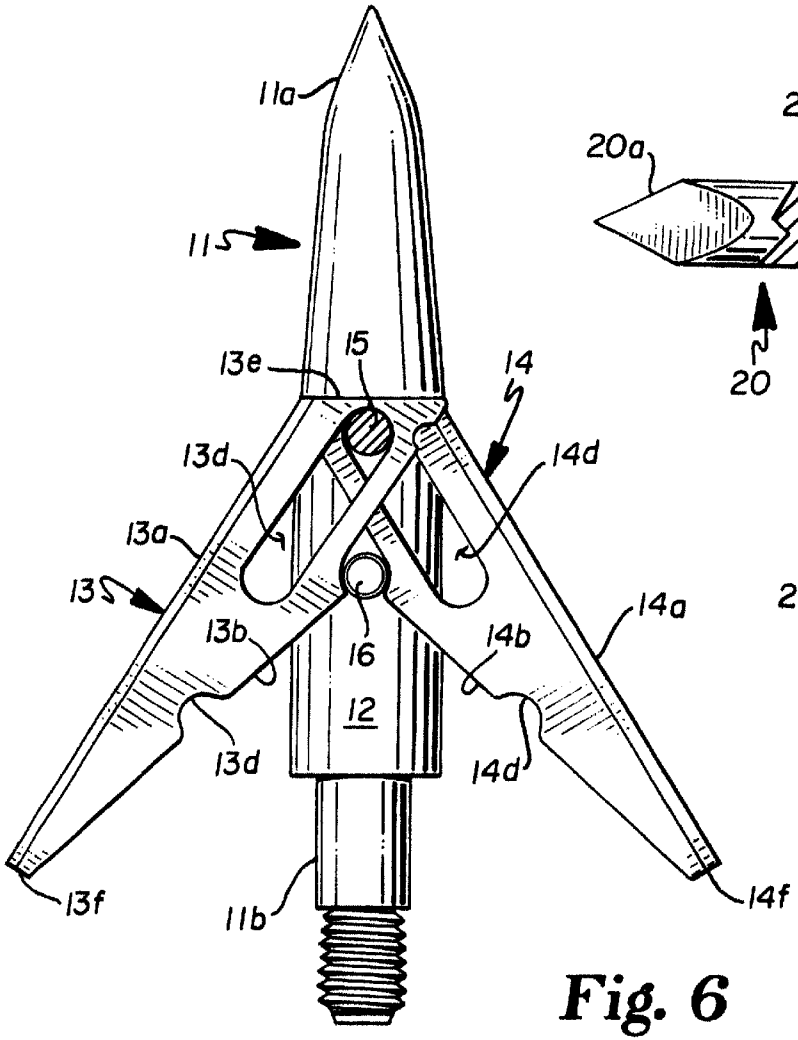
FIG. 6 is a view similar to FIGS. 4 and 5 and illustrating the expanding blades in their fully expanded position.

This sequence of blade movement and expansion is illustrated in FIGS. 4, 5 and 6 with the exception of the continued movement of the blades 13, 14 for removal from the target.

Figure 7:
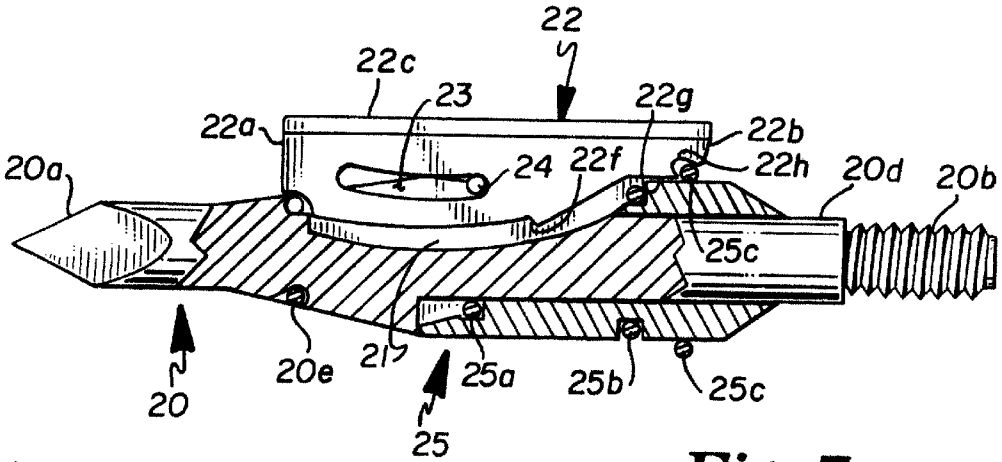
FIG. 7 is a view taken substantially along Line 7—7 of FIG. 2 showing a single blade of the multiple blade form of the invention in inflight position.
Figure 10:
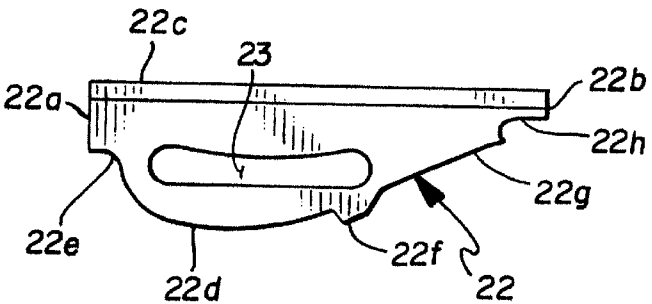
Figure 8:
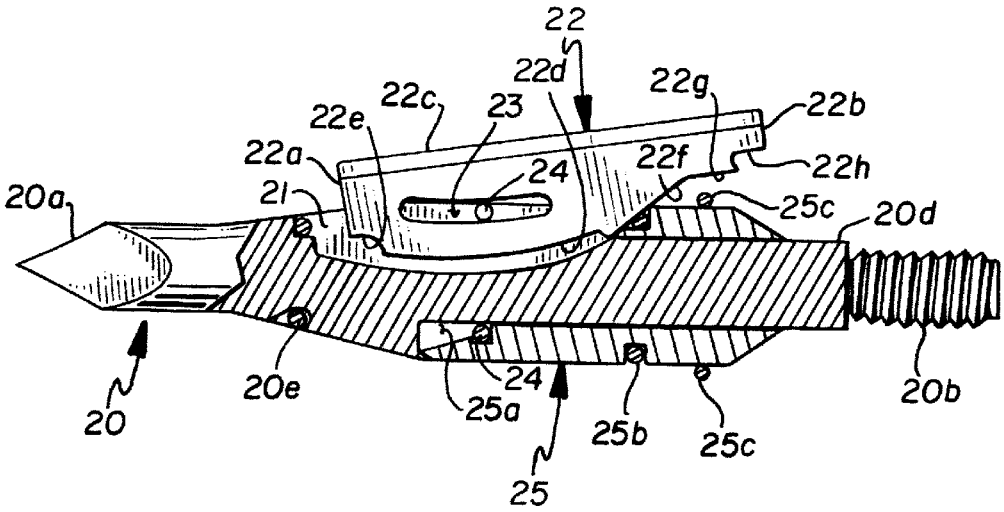
FIG. 8 is a view similar to FIG. 7 illustrating the expanding blade in a partially expanded position.
Figure 9:
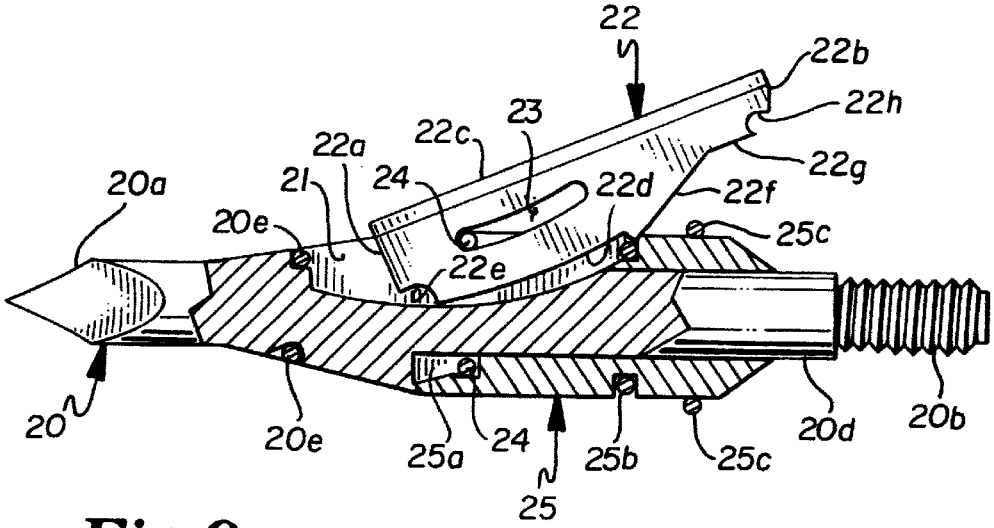
FIG. 9 is a view similar to FIGS. 7 and 8 illustrating the expanding blade in it fully expanded position; and, FIG. 10 is a side elevation of the blade that is illustrated in FIGS. 2, 7, 8 and 9.

A second form of the invention is sequentially shown in FIGS. 7, 8 & 9 with a separate blade being illustrated in FIG. 10. This form of the invention does not depart from the scope of the invention illustrated and described hereinabove but utilizes a different mechanical action to accomplish the same results.

In this form of the invention a number of blades may be, preferably arcuately, spaced about a broadhead body, by providing grooves partially formed into the body with means to retain the blades in such grooves while permitting rearward movement and resulting in outward expansion of the rear ends thereof as a result of striking and entering a target to, again, enlarge the entry hole into the target. Although the blades are illustrated as being in alignment with the axis of the broadhead, it should be obvious that the blades may be arranged angularly therewith without departing from the scope of the invention.

As illustrated in these Figures, the broadhead provides a longitudinally extending body 20 having a forward, target penetrating end 20*a* with the variations of shape as stated above and a rear arrow shaft mounting end 20*b*. It should be understood that a number of blades, preferably three, may be arcuately spaced on a broadhead body 20 and the selected drawings illustrate only one such blade and one groove 21 to receive the same.

Therefore broadhead body 20 includes grooves 21 formed therein to receive blades 22, retain them within such grooves, allow them to move rearwardly in the grooves 21 as the broadhead penetrates a target and the front end 22*a* thereof abuts with the target, to cause the rear end 22*b* to expand radially outwardly.

Each of the blades 22 includes an exterior cutting surface 22*c* with an inner surface 22*d* that has no required, defined shape other than to provide a first, closed or inflight, locking notch 22*e* adjacent the front end 22*a* thereof, a second, expanded or cutting, locking lug 22*f,* a flat rest surface 22*g* adjacent the rear end 22*b* thereof and a second inflight holding notch 22*h* at the end of the rest area, adjacent the rear end 22*b.* Both notches 22*e,* 22*h* may be utilized or a singular one may be used.

In order to maintain the blades 22 in the respective grooves 21 and permit longitudinal movement thereof, a weight or mass reducing slot 23 is formed transversely of the blades 22 and, in the form shown, this slot is, preferably, arcuately formed such that as the blades 22 are moved rearwardly, they will move in an arc guided and held by a retaining member 24.

To facilitate assembly of this form of the broadhead, Applicants provide a structure which includes a second body part 25. To receive this second body part 25, the primary body 20 provides an area of reduced cross section 20*d* along a portion thereof and second body part 25 is fitted thereon. The frontal portion 25*a* of body part 25 provides an internal shoulder to receive blade retaining member 24. Retaining member 24 may, as in the form shown, constitute a split ring such that it may be introduced into the slots 23 of the blades 22 to retain the same while permitting movement thereof. Individual pins or other elements, for retaining the individual blades could be utilized and would provide the same attachment of blades to body. A one piece unit with similar retaining means may be used without departing from the scope of the invention.

With this slot 23, retaining member 24 relation, it should be obvious that as the blades 22 are moved rearwardly, the blades 22 will move in accordance with the arcuate slot 23 to force the rear end 22*b* outwardly from the body 20 into the entrance hole enlarging position.

As illustrated, an open position locking member 25*b,* which may take the form of a ring is provided on the second body part 25 and as the blade 22 moves therepast, the aforesaid lug 22*f* will engage the same and prevent inward or return movement of the blade 22 and hold the same in the open, cutting position.

When the blades are in the inflight position, the first mentioned blade notch 22*e* is received about a lock member 20*e* that, again, may be in the form of a selected ring on body 20. This lock member 20*e,* notch 22*e* relation eliminates the retainer 17 of the first form of the invention and is simply another method for retaining the inflight dimension.

During inflight, the aforementioned rest surface 22*b* will rest upon the open lock member 25*b* and the rearmost notch 22*h* will lock against and to an additional, selected, ring member 25*c.* Rearward movement of the blade 22 will override the lock and, as stated a single such lock may be utilized.

The function of this form of broadhead should be obvious from the sequential motion Figures, namely, FIGS. 7, 8 and 9. The blades 22 will be within the body groove 21 with frontal notch 22*e* engaging body ring 20*e* and rear notch 22*h* engaging ring 25*c.* As the broadhead enters the target, the front end 22*a* of blade 22 will contact the target surface and continued movement of the broadhead into the target will force the blade 22 rearwardly past all inflight lock elements to be guided by the formed slot 23. Such movement will force the blade 22 rear end 22*b* into radially outwardly expanded position.

A single blade encompassing the second form of the invention is illustrated in FIG. 10 bearing the same indicia utilized in describing the operational movement of the blade 22.

This form of the invention will also allow for continued movement of the blades to prevent the aforementioned barbing effect.

The broadhead provided herein, of either form, accomplishes blade expansion through two related and relatively simple mechanical arrangements which eliminate the normally provided complex expansion systems of the present and prior art.

What is claimed is:

1. A broadhead having expanding blades, expanding upon striking and entering a target, including;

a) a longitudinally extending body having a forward, target penetrating end and a rearward end attachable to an arrow shaft;

b) at least one longitudinally extending groove formed in said body;

c) a blade, having a forward end and a rear end, positioned in said body groove, said blade including:

1) a cutting surface directed outwardly of said body;

2) mass reducing, guiding means permitting longitudinal movement of said blade within said groove;

d) blade holding means for retaining said blade within said body groove while permitting rearward movement thereof; and, e) said guiding means and said blade holding means permitting longitudinal movement of said blade within said body groove while allowing said rear end of said blade to move radially outward of said body groove to a radially expanded position.

2. The broadhead having expanding blades as set forth in claim 1 wherein;

a) said body is provided with at least a pair of arcuately spaced grooves; and, b) each of said grooves is provided with a blade.

3. A broadhead having expanding blades as set forth in claim 1 wherein;

a) said body is provided with a plurality of arcuately spaced grooves; and, b) each of said grooves is provided with a blade.

4. A broadhead having expanding blades as set forth in claim 1 wherein said guiding means includes a slot formed in said blade.

5. A broadhead having expanding blades as set forth in claim 4 wherein said blade holding means is associated with said slot.

6. A broadhead having expanding blades as set forth in claim 4 and said blade slot being arcuately shaped to shift said rear end of said blade outwardly to an expanded, cutting position, as the same is shifted longitudinally within said slot.

7. A broadhead having expanding blades as set forth in claim 1 and means for holding said blades in a closed, inflight position.

8. A broadhead having expanding blades as set forth in claim 1 and means for holding said blades in expanded position.

* * * * *